US005163665A

United States Patent [19]

Klearman

[11] Patent Number: 5,163,665

[45] Date of Patent: Nov. 17, 1992

[54] UNIVERSAL GRIPPING TOOL ASSEMBLY

[76] Inventor: Barnett M. Klearman, 722 Jusdon Manor, St. Louis, Mo. 63141

[21] Appl. No.: 723,978

[22] Filed: Jul. 1, 1991

Related U.S. Application Data

[63] Continuation-in-part of Ser. No. 472,269, Jan. 30, 1990, abandoned.

[51] Int. Cl.[5] ..... B25B 1/24; B25B 5/16

[52] U.S. Cl. ..... 269/280; 294/86.4; 294/902

[58] Field of Search ..... 294/86.4, 86.41, 119.1, 294/902; 269/279, 280, 281, 282, 283, 284; 279/8, 9 R, 99, 102

[56] References Cited

U.S. PATENT DOCUMENTS

| | | | |
|---|---|---|---|
| 2,174,947 | 10/1939 | Ramsey | 269/282 X |
| 3,061,357 | 10/1962 | Wright | 294/902 X |
| 3,545,777 | 12/1970 | Friedheim | 279/99 |
| 4,051,966 | 10/1977 | Cotton | 294/902 X |
| 4,576,067 | 3/1986 | Buck | 269/283 X |
| 4,592,682 | 6/1986 | Vanistendael | 269/282 X |

FOREIGN PATENT DOCUMENTS

| | | | |
|---|---|---|---|
| 1237780 | 6/1960 | France | 269/282 |

*Primary Examiner*—Margaret A. Focarino
*Assistant Examiner*—Dean J. Kramer
*Attorney, Agent, or Firm*—Rogers, Howell & Haferkamp

[57] ABSTRACT

A gripping assembly is provided that includes a pair of gripping members that are attached to, or formed unitary with, the opposed faces of the jaws of a gripping tool or vise, and a set of adapters that are releasably attached to the front faces of the gripping members. The gripping members are provided with a variety of different surface configurations for engaging and securely holding a large number of different shaped objects. The adapter members are also provided with a variety of different shaped surface configurations that, when attached to the front surfaces of the gripping members, adapt the gripping members of the assembly to engage and securely hold a large number of different shaped objects. The gripping members of the assembly are also provided with a flexible overlay that is attached over the front surface configurations of the gripping members to enable them to securely hold objects therebetween without scratching or marring the objects.

15 Claims, 3 Drawing Sheets

FIG. 1.
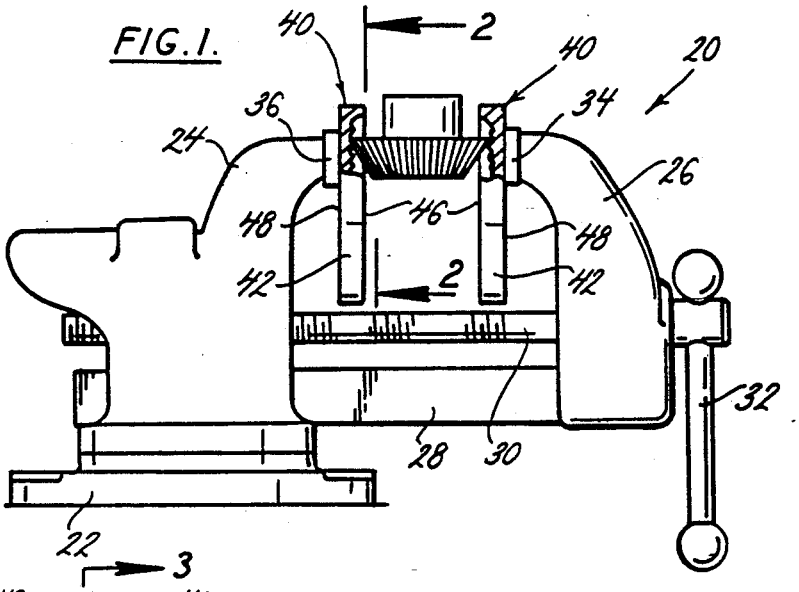
FIG. 2.
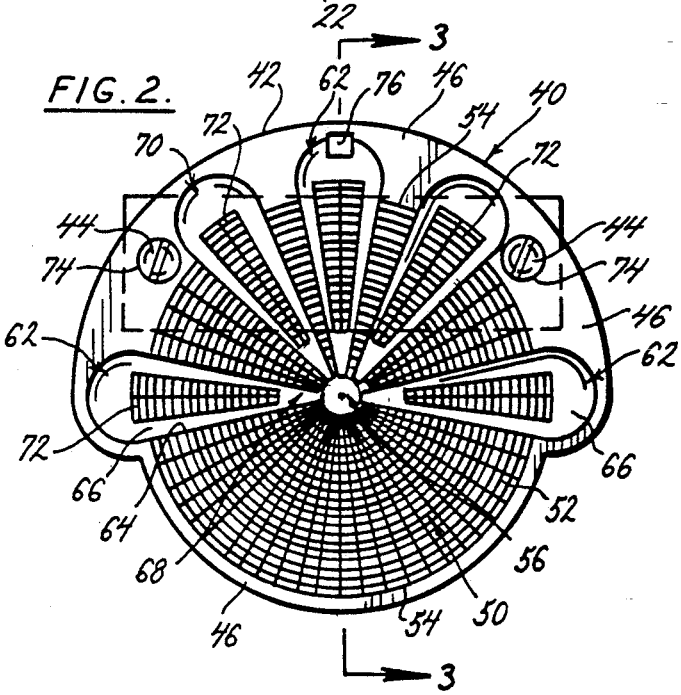
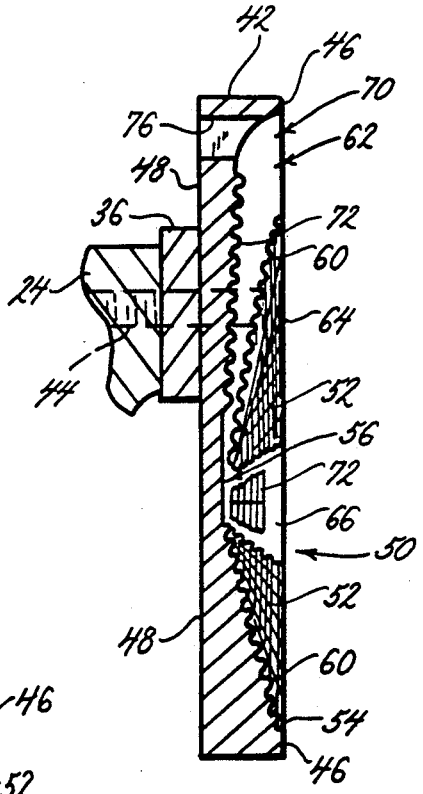
FIG. 3.
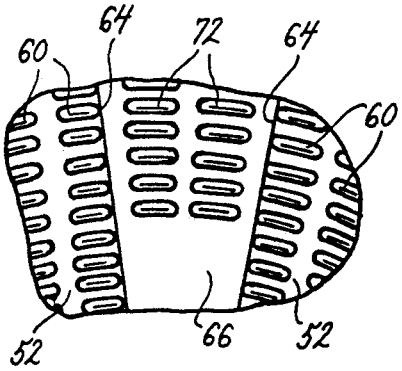
FIG. 4.
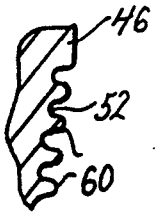
FIG. 5.

FIG. 10.
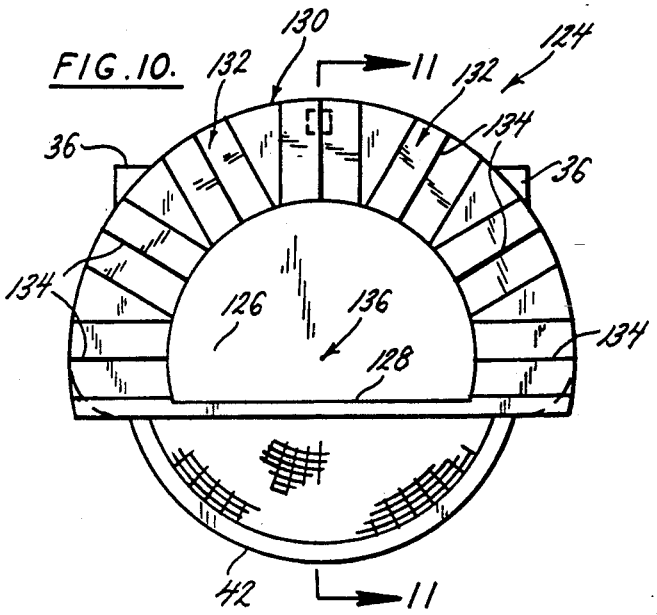
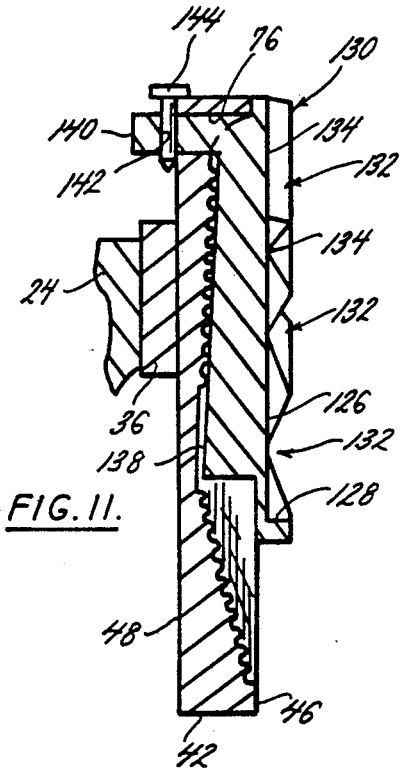
FIG. 11.
FIG. 12.
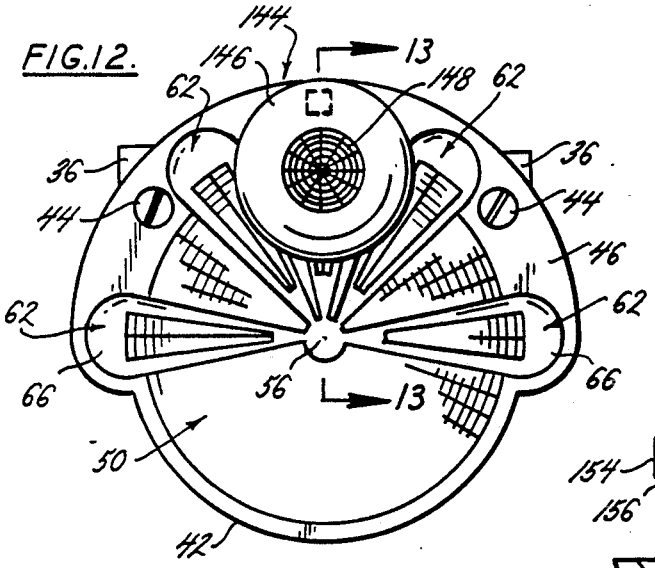
FIG. 13.
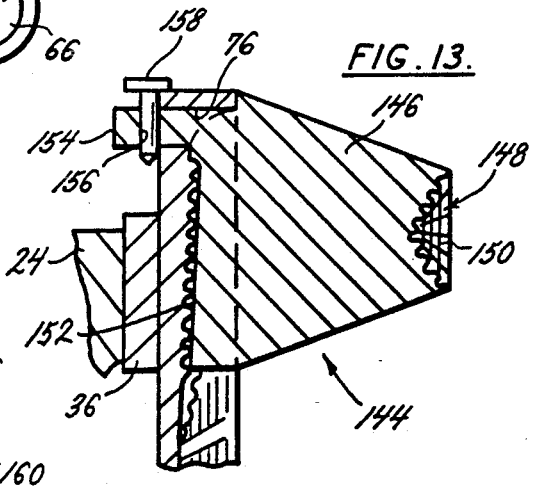
FIG. 14.
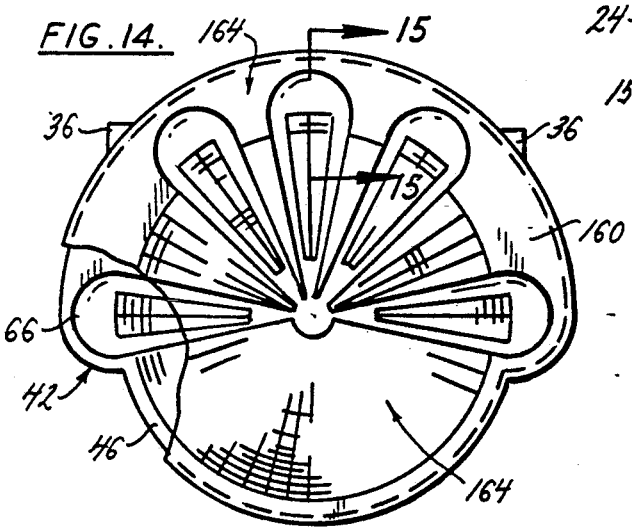
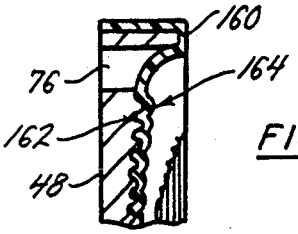
FIG. 15.

UNIVERSAL GRIPPING TOOL ASSEMBLY

This is a Continuation-in-Part application of U.S. patent application Ser. No. 07/472,269, filed Jan. 30, 1990 and now abandoned.

BACKGROUND OF THE INVENTION (1) Field of the Invention

This invention relates to a gripping assembly employed in holding stationary a variety of different shaped objects. In an exemplary application, the assembly includes a pair of gripping members with vise attachments for attachment of the gripping members to the opposed jaws of a vise system. Specifically, the invention pertains to a pair of gripping members that are attached to, or formed unitary with, the opposed faces of the jaws of a gripping tool such as a vise. However, it should be understood that adaptations of the invention may also be used with other gripping tools with the configuration of the opposed engagement faces of the gripping members adapting the tools to hold a variety of differently shaped objects between the gripping members.

(2) Description of the Related Art

A variety of different types of clamping attachments for the opposed jaws of a vise are known in the art. These known clamping attachments comprise engagement faces that are specifically configured to engage and hold specific geometric shapes. For example, various types of clamping attachments are known which are designed to securely hold cylindrical and spherical shapes.

A disadvantage often found in the prior art clamping attachments is that their engagement surfaces are specifically configured to engage and hold objects of only one geometric configuration. In the prior art, various clamping attachments are known which are specifically designed to engage and hold cylindrical shapes such as piping and engine piston heads. Many of these prior art clamping attachments are not very effective in holding objects with rounded or spherical shapes. Moreover, many conventional clamping attachments designed to hold spherical or round shaped objects are not very effective in holding cylindrical shaped objects.

The present invention overcomes the aforesaid disadvantages of prior art vise clamping attachments by providing an improved pair of vise attachment gripping members and a set of gripping adapters for the members that together engage and hold objects having a variety of different shapes such as vehicle U-joints, brake cylinders, beveled gears, spherical objects, pointed objects and others. The members and the adapters of the present invention are described as being attached over the mutually opposed faces of the jaws of a vise, the vise jaws being adjustable toward each other to grip objects between the gripping members and their adapters. The gripping members and the set of adapters have surface configurations on their opposed front surfaces that are designed to engage and hold a variety of different shaped objects.

SUMMARY OF THE INVENTION

The gripping assembly of the present invention is generally comprised of gripping members, preferably used in pairs, and a set of adapters that are used in conjunction with the gripping members to securely grip and hold a variety of different shaped objects.

The pair of gripping members of the present invention are substantially identical members that are adapted to be attached to, or formed unitary with, the opposed faces of the jaws of a gripping tool such as a vise. Alternatively, only one of the gripping members may be used with a vise or other gripping tool, with the gripping member being attached to one of the jaw faces of the vise and being opposed by the other jaw face of the vise. When used with the set of adapters of the invention, the gripping member and adapters can grip and hold a large variety of different shaped objects between the opposed jaw faces of the vise.

The gripping assembly of the invention is described herein as being attached to a vise as an example of its many applications. This application is not intended to be limiting but only illustrative of the operation of the present invention.

The pair of gripping members are attached to the opposed vise jaws in any manner including, but not limited to, threaded fasteners extending through holes through the gripping members and into the opposed faces of the vise jaws, or by providing a dovetail or tongue-and-groove connection between the faces of the vise jaws and the back surfaces of the gripping members. The members may also be formed unitary with the opposed vise jaws.

Each of the gripping members has opposite front and back surfaces that are substantially planar and parallel to each other. When a pair of gripping members are used, the front surfaces of the members are oriented in mutually opposed positions with the gripping members secured to the opposed jaw faces of a vise. The front surfaces of each of the gripping members are provided with three different surface configurations that enhance their gripping ability.

The first surface configuration of each gripping member is a hollow formed in the member by a recessed surface that extends into the member from the member's front surface. The recessed surface of the hollow has a tapered configuration that tapers gradually from a peripheral edge of the recessed surface to a center area of the recessed surface at the center of the hollow. The recessed surface of the hollow provides the first surface configuration for gripping objects.

The second surface configuration of each gripping member is formed by a plurality of projections formed over the recessed surface of the hollow. The projections are arranged in concentric circles spacially arranged from the center of the hollow recessed surface out toward the peripheral edge of the recessed surface. Projections in successive circles are arranged extending radially outward from the center most circle of projections to the outer most circle of projections. The projections provide the second surface configuration for engaging objects and securely holding objects relative to the gripping member.

The third surface configuration is provided by a plurality of curved flutes that are formed into the recessed surface of the hollow of each member. Each of the flutes has a peripheral edge that lies primarily on the recessed surface of the hollow, and also includes an interior surface having a general concave configuration that extends deeper into the gripping member from the recessed surface of the hollow. The peripheral edge of each flute has a general teardrop configuration with the point of the teardrop being adjacent the center area of the hollow recessed surface, and with the teardrop configuration extending radially outward from the center area to bulbous ends of the flutes slightly outside the peripheral edge of the hollow. The teardrop configuration of the flutes not only enables objects to be engaged and securely held relative to the gripping member by the peripheral edges of the flutes, but also enables objects to be engaged in the interiors of the flutes by either engaging the objects against the concave interior surface of the flutes or wedging the objects between the peripheral edges of the flutes tapering to the point of their teardrop configuration. Each of the flutes are also provided with pluralities of projections formed on the interior surfaces of the flutes. Like the projections formed on the recessed surface of the hollow, the projections formed in the interior surfaces of the flutes also provide an additional engaging surface configuration for securely holding objects relative to the gripping member.

Each of the gripping members is provided with a pair of holes on opposite sides of the gripping members that extend completely through the members from the front surface to the back surface. The holes are provided to receive threaded fasteners to be used in releasably securing the gripping members to the opposed jaw faces of a vise or other gripping tool. As stated earlier, other methods of attaching the gripping members to the opposed jaw faces of a gripping tool may be employed without departing from the intended scope of the invention.

A third hole is provided in each gripping member extending through the members from the front surfaces to the back surfaces. This third hole is positioned adjacent the peripheral edge of the gripping member at the top of the gripping member. The third hole is provided to receive a connecting post formed on each of the adapters of the set of adapters, to releasably connect the adapters to the front surface of the gripping member. The hole may also be employed in gripping pointed objects by inserting a pointed end of the object into the hole.

In the preferred embodiment of the invention the set of adapters includes four adapter members. It should be understood that the set of adapters could include fewer or more than the four adapters described, thereby providing additional varieties of gripping surface configurations for engaging and securely holding objects of different shaped configurations by the gripping members and the set of adapters of the invention. Each of the adapters includes a front and back surface and a post formed on the back surface extending from the adapter member. The post is dimensioned to be received in the third hole of the gripping member to releasably attach the adapter to the gripping member. An annular groove is cut around the distal end of the post. The annular groove is positioned adjacent the back surface of the gripping member with the post inserted through the third hole of the gripping member, and a C-spring or other equivalent type of fastener may be releasably secured in the annular groove to releasably attach each of the adapter members to the gripping member. Alternatively, a hole may be provided through the post adjacent its distal end for receiving a pin to releasably attach the adapter on the front surface of the gripping member. The back surface of each of the adapters is also configured in a complementary configuration to that of the front surface of the gripping member. This enables each of the adapter members to nest securely into the front surface configurations of the gripping member when each adapter member is attached to the gripping member. The complementary surface configurations of the back surfaces of the adapter members and the front surface of the gripping member securely holds the adapter members stationary relative to the gripping member.

The front surface configurations of the four adapter members are all different. A first of the adapter members has a front surface configuration in the general shape of a planar half circle with pluralities of projections formed on the front surface of the half circle. The plurality of projections are arranged in the configuration of concentric, spacially arranged arcs, the projections in successive arcs being arranged in the configuration of straight lines radiating outward from what would be the circular center of the half circle adapter. As with the gripping member, the plurality of projections of the first adapter are provided for engaging objects and securely holding objects against movement relative to the first adapter member and the gripping member to which it is attached.

The front surface of the second adapter member has a general semi-circular shape with a plurality of spacially arranged flutes formed in the front surface. The flutes are substantially identical to the flutes formed in the gripping member, and the pointed ends of the flutes are concentric with what would be the circular center of the semi-circular adapter member.

The third adapter member also has a general semi-circular configuration. The front surface of the adapter has a flat recessed center portion, a ledge formed extending across a straight portion of the peripheral edge of the adapter, and a band of V-shaped grooves extending around the semi-circular peripheral edge of the adapter. Each of the grooves are arranged in the peripheral band of grooves with the bottom most edges or valleys of the grooves being positioned along lines extending radially outward from what would be the circular center of the semi-circular adapter member.

The fourth adapter member has a front surface that is extended out forward from the front surface of the gripping member by the body of the adapter member. The front surface has a circular configuration and the surface itself is formed as a shallow tapered recess that extends into the front surface of the adapter member. The tapered recess is provided with a plurality of projections on the surface of the recess similar to the projections of the gripping member.

The gripping assembly of the present invention is also provided with flexible or resilient overlays. The overlays have a back surface that is shaped to complement the front surface of either the gripping member or one of the adapters of the set of adapters, enabling the overlays to nest in the surface configurations of the gripping member and adapters to securely but releasably attach the overlays to the gripping member and adapters. The front surface of the overlays resembles the front surface of the gripping member and the front surfaces of each of the adapters in that they are also configured with the surface configurations of the gripping member and adapters. The flexible or resilient material of the overlays protect objects held by the gripping member and the adapters from being scratched or marred.

BRIEF DESCRIPTION OF THE DRAWINGS

Further objects and features of the present invention are revealed in the following detailed description of the preferred embodiments of the invention and in the drawing figures wherein:

FIG. 1 is a side elevation view of a pair of gripping members of the gripping assembly of the present invention in their operative positions attached to opposed jaws of a vise assembly and gripping a beveled gear;

FIG. 2 is a front elevation view of a gripping member of the present invention;

FIG. 3 is a side elevation view, in section, of the gripping member of FIG. 1 taken along the line 3—3 of FIG. 1;

FIG. 4 is a segment of a front elevation view of the gripping member of the invention showing the details of projections provided on the front surface of the member;

FIG. 5 is a segmented side view, in section, of the projections on the front surface of the gripping member;

FIG. 10 is a front elevation view of a third adapter of the set of adapters of the present invention attached over the front surface of the gripping member of the invention;

FIG. 11 is a side elevation view, in section, of the adapter of FIG. 10 taken along the line 11—11 of FIG. 10;

FIG. 12 is a front elevation view of a fourth adapter of the set of adapters of the present invention attached over the front surface of the gripping member of the invention;

FIG. 13 is a side elevation view, in section, of the adapter of FIG. 12 taken along the line 13—13 of FIG. 12;

FIG. 14 is a front elevation view of the flexible overlay of the present invention releasably attached over the front surface of the gripping member of the present invention; and FIG. 15 is a segmented side elevation view, in section, of the overlay of FIG. 14 taken along the line 15—15 of FIG. 14.

DESCRIPTION OF THE PREFERRED EMBODIMENT

Figure 6:
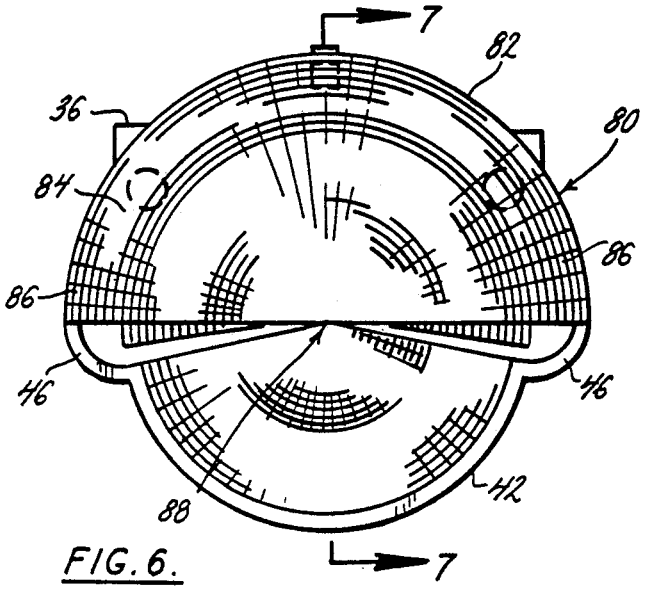
FIG. 6 is a front elevation view of a first adapter of the set of adapters of the present invention attached over the front surface of the gripping member of the invention.

FIG. 1 shows an exemplary operative environment of the present invention. Although FIG. 1 shows a specific structure for a vise assembly, it should be understood that the present invention is intended to be used with many different types of opposed jaw gripping tools besides the vise assembly shown in FIG. 1.

The vise assembly 20 of FIG. 1 is generally comprised of a base 22 supporting a back jaw member 24 and a movable front jaw member 26. A slide 28 extends from the front jaw member 26 through a channel (not shown) in the back jaw member 24. A screw 30 is mounted for rotation in the front jaw member 26 and extends into a screw threaded channel (not shown) extending through the back jaw member 24. A handle 32 is provided on a portion of the screw that projects from the front jaw member 26. Rotating the handle 32 in opposite directions adjusts the front jaw member 26 toward and away from the back jaw member depending on the direction of handle rotation.

The front jaw member 26 is provided with a jaw face 34 and the back jaw member 24 is also provided with a jaw face 36. The jaw face of the front jaw member is positioned directly opposite the jaw face of the back jaw member as seen in FIG. 1, and the jaw face 34 of the front jaw member is adjusted toward and away from the jaw face 36 of the back jaw member by selectively rotating the handle 32 and screw 30 in opposite directions.

The gripping assembly 40 of the present invention is described as being attached to a jaw face of a vise such as that shown in FIG. 1. This application is one example of the many applications of the gripping assembly of the invention, and is not intended to be limiting but only illustrative of the operation of the present invention. In alternative applications of the invention, only one of the gripping assemblies may be used with a vise or other gripping tool, with the gripping assembly being attached to one of the jaw faces of the vise or tool and being opposed by the other jaw face of the vise or tool. When used with the set of adapters of the invention, the gripping assembly can grip and hold a large variety of different shaped objects between the opposed jaw faces of the vise or gripping tool.

The gripping assembly 40 of the present invention is generally comprised of a gripping member 42, that is preferably used in pairs, and a set of adapters used in conjunction with the gripping members to securely grip and hold a variety of differently shaped objects. In the preferred operative environment of the invention shown in FIG. 1, the pair of gripping members 42 are attached to the opposed jaws 34, 36 of the vise by threaded fasteners 44. The gripping members 42 are attached to the vise jaws in an off center orientation relative to the vise jaws. This enables the gripping members 42 to grip objects in a position elevated above the vise jaws, as well as gripping objects between or below the jaws. Although threaded fasteners are employed in the illustrative environment shown in the drawing figures, other methods of fastening the gripping members to the opposed jaw faces of a vise or gripping tool may be employed. The gripping members may also be formed unitary with the opposed vise jaws.

Each of the gripping members 42 has opposite front 46 and back 48 surfaces that are substantially parallel to each other. The planar front surface 46 of each gripping member 42 has three different surface configurations formed therein that enhance the gripping ability of each member.

The first surface configuration of each gripping member is formed by a hollow 50 in the front surface of the member. The hollow 50 is defined by a recessed surface 52 that extends into the gripping member from the front surface 46 of the member. As is best seen in the cross section of the gripping member shown in FIG. 3, the recessed surface 52 of the hollow has a tapered configuration that tapers gradually from a peripheral edge 54 of the recessed surface to a center area 56 of the recessed surface at the center of the hollow 50. The center area 56 of the recessed surface 52 marks the deepest extension of the surface into the gripping member 42 from the planar front surface 46 of the member.

The second surface configuration of each gripping member is provided by a plurality of projections 60 formed on the recessed surface 52 of the hollow 50. As seen in the detail of the projections 60 shown in FIGS.

4 and 5, each projection has a general oblong shape and projects a slight distance out from the recessed surface 52 of the hollow 50. The projections 60 are arranged in concentric circles spacially arranged from the center area 56 of the recessed surface 52 out toward the peripheral edge 46 of the surface. The circular arrangement of the projections is best seen in FIG. 2. The projections 60 in successive outwardly progressing circles are arranged extending radially outward from the center most circle of projections to the outer most circle of projections. With this arrangement, the projections 60 arranged in the center most circle on the recessed surface 52 are smaller than the projections 60 arranged in the outer most circle of projections formed on the surface. This is apparent from drawing FIG. 2. Although the perimeters of each projection 60 decrease in size as the projections approach the center area 56 of the recessed surface 52, the extent that the projections 60 project out from the recessed surface 52 is substantially the same for all the projections formed on the recessed surface. The projections 60 provide an additional surface configuration for engaging objects and securely holding objects relative to the gripping member 42.

The third surface configuration formed in the front surface 46 of each gripping member 42 is formed by a plurality of curved flutes 62 that are formed into the front surface 46 and the recessed surface 52 of the hollow 50 of each member. As is best seen in drawing FIG. 2, each of the flutes 62 has a peripheral edge 64 that primarily lies on the recessed surface 52 of the hollow 50, and partially lies on the planar front surface 46 of the gripping member 42. Each of the flutes 62 also includes an interior surface 66 having a general concave configuration that extends deeper into the gripping member 42 from the recessed surface 52 of the hollow 50 and the planar surface 46 of the gripping member front face. As seen in drawing FIG. 2, the peripheral edge 64 of each flute 62 has a general teardrop configuration with a point 68 of the flute being adjacent the center area 56 of the hollow recessed surface 52. The teardrop configuration extends radially outward from the center area 56 to bulbous distal ends 70 of the flutes formed in the planar surface 46 of the gripping member 42 outside the peripheral edge 54 of the recessed surface 52.

The general concave configuration of the interior surface 66 of the flutes 62 enables objects to be inserted into the flutes and engaged against the curved interior surface 66, with the curvature of the interior surface 66 securely holding the inserted object against movement relative to the gripping member 42. The teardrop configuration of the flutes 62 also enables objects to be engaged and securely held by the peripheral edges 64 on opposite sides of the flutes by engaging the object between the edges of the flutes. FIG. 1 shows a bevel gear securely held between the opposite peripheral edges 64 of opposing flutes 62 of the pair of gripping members 42. The tapering teardrop configuration of the flutes enables objects of different sizes to be inserted between the opposing peripheral edges 64 of the flute and held securely in place. The tapered teardrop configuration enables objects to be inserted between opposite peripheral edges 64 of a flute and wedged between the edges tapering to the flute point 68.

Each of the flutes 62 are also provided with a second plurality of projections 72 formed on the curved interior surfaces 66 of the flutes. Like the first plurality of projections 60 formed on the recessed surface 52 of the hollow, the second plurality of projections 72 formed in the interior surfaces 66 of the flutes also provide an additional engaging surface configuration for securely holding objects relative to the gripping member 62. As is best seen in FIG. 4, the projections 72 of the second plurality of projections are arranged in pairs on the curved interior surface 66 of each flute. The successive pairs of projections 72 are arranged in lines extending radially from adjacent the pointed end 68 of the flutes out toward the bulbous ends 70 of the flutes.

Both of the gripping members are provided with at least a pair of holes 74 positioned at opposite sides of the gripping members and extending completely through the gripping members from their front planar surface 46 to their back surface 48. The holes are provided to receive threaded fasteners 44 used in releasably securing the gripping members 42 to the opposed jaw faces 34, 36 of a vise or other gripping tool. As stated earlier, other methods of attaching the gripping members to the opposed jaw faces of a vise or other gripping tool may be employed without departing from the intended scope of the invention.

A third hole 76 is also provided in each gripping member. The third hole is positioned adjacent the peripheral edge of the gripping member 42 at the top of the member and also extends completely through the member from the front surface 46 to the back surface 48. The third hole 76 is provided to receive a connecting post formed on each of the adapters of the set of adapters of the present invention in a manner to be explained, to releasably connect the adapters to the front surface of the gripping member. The hole 76 may also be employed in gripping a pointed object by inserting a pointed end of the object into the hole.

In the preferred embodiment of the invention, the set of adapters includes four adapters. In variants of this embodiment the set of adapters could include fewer than or more than the four adapters to be described, thereby providing different varieties of gripping surface configurations for engaging and securely holding objects of differently shaped configurations by the gripping members and the set of adapters of the invention.

Figure 7:
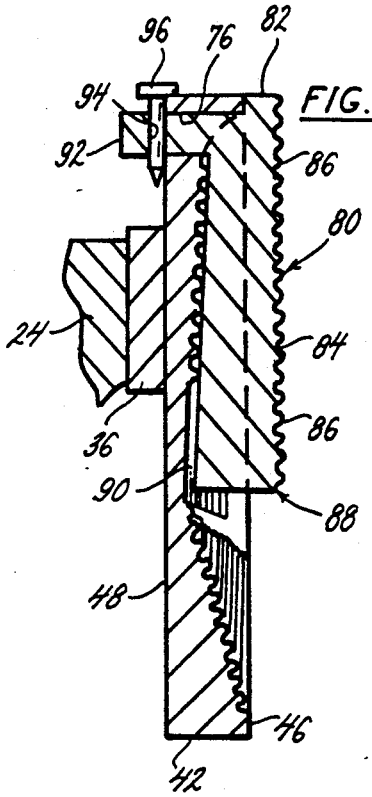
FIG. 7 is a side elevation view, in section, of the adapter of FIG. 6 taken along the line 7—7 of FIG. 6.

A first adapter 80 of the set of four adapters is shown in FIGS. 6 and 7 of the drawing figures. The adapter 80 adapts the gripping member front surface 46 for holding objects with flat surfaces. The first adapter has a general semi-circular shaped perimeter 82 and a front surface 84 configured in the general shape of a planar half circle. A plurality of projections 86, similar to the projections of the first and second pluralities described earlier, are formed on the front surface 84 of the adapter half circle. The pluralities of projections are arranged in the configuration of concentric, spacially arranged arcs, the projections in successive arcs being arranged in the configuration of straight lines radiating outward from what would be the circular center 88 of the half circle adapter. As described earlier with regard to the first and second pluralities of projections of the gripping member 42, the plurality of projections 84 of the first adapter 80 are provided for engaging objects and securely holding objects against movement relative to the adapter member and the gripping member to which it is attached.

The back surface 90 of the first adapter 80 is configured in a complementary configuration to the configuration of the front surface 46 of the gripping member 42. This enables the adapter member 80 to nest securely into the front surface configurations of the gripping member 42 when the adapter member is attached to the gripping member. This nesting engagement is best seen in FIG. 7. In FIG. 7 it can be seen that portions of the first adapter back surface 90 will nest into the recessed hollow 50 of the gripping member and portions of the back surface 90 will nest into the curved flutes 62 of the gripping member.

A post 92 is formed on the back surface 90 of the adapter member projecting outward from the back surface. The post 92 is dimensioned to be received in the third hole 76 of the gripping member 42 to releasably attach the adapter to the gripping member. A hole 94 is provided in the post 92 in a position where the hole will be exposed behind the gripping member back surface 48 when the adapter member 80 is attached to the gripping member. The insertion of the adapter post 92 through the gripping member third hole 76 can be seen in FIG. 7. As seen in FIG. 7, a pin 96 is inserted through the post hole 94 to releasably secure the adapter member 80 onto the front face of the gripping member 42. The adapter post and pin arrangement is just one method of releasably attaching the adapter member 80 to the gripping member 42. Other equivalent methods of attaching the adapter member to the gripping member may be employed without departing from the intended scope of the invention.

Figure 8:
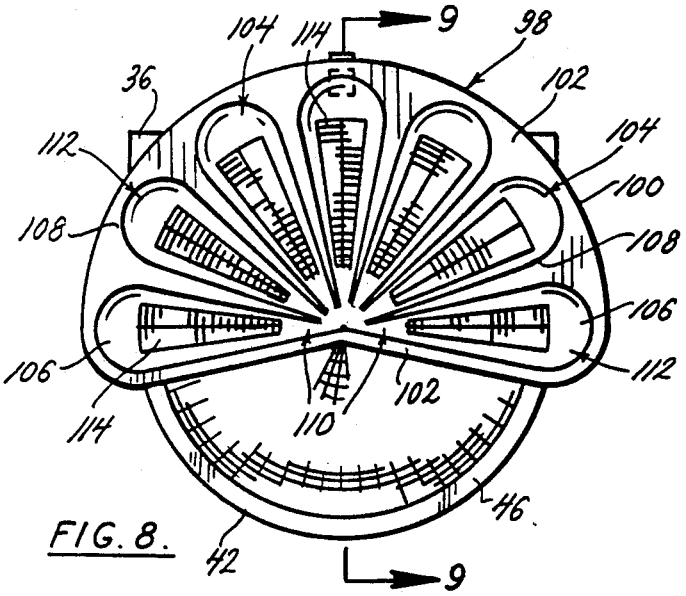
FIG. 8 is a front elevation view of a second adapter of the set of adapters of the present invention attached over the front surface of the gripping member of the invention.
Figure 9:
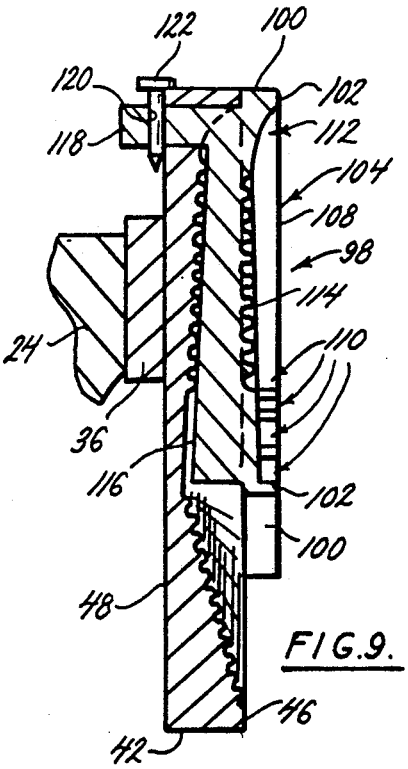
FIG. 9 is a side elevation view, in section, of the adapter of FIG. 8 taken along the line 9—9 of FIG. 8.

The second adapter member 98 of the present invention is shown in FIGS. 8 and 9 releasably attached onto the front surface 46 of the gripping member 42. As seen in FIG. 8, the second adapter member 98 has a general semi-circular configuration with the peripheral edge 100 of the adapter member fanning out to slightly greater than a half circle configuration. The front surface 102 of the second adapter 98 is planar with a plurality of curved flutes 104 being formed into the front surface. The flutes 104 are substantially identical to the flutes 62 of the gripping member 42 in that they also include a curved interior surface 106 and a teardrop shaped peripheral edge 108. Each of the flutes 104 tapers toward a point at one end 110 and expands as they extend radially outward toward a bulbous end 112. The flutes 104 are also provided with pluralities of projections 114 formed on their interior surfaces 106 in substantially the same configuration as the flutes 62 of the gripping member 42. The flutes 104 provided on the second adapter 98 grip and hold objects in much the same manner as the flutes 62 of the gripping member 42 described above except that the peripheral edges of the adapter flutes do not taper toward the center of the semi-circular adapter configuration.

The back surface 116 of the second adapter 98 is also provided with a post 118 having a post hole 120 and pin 122. The post, post hole and pin are substantially identical to the post, post hole and pin of the first adapter member 80 and releasably secure the second adapter member to the front surface of the gripping member 42 in the same manner as the first adapter member described above. Like the first adapter member, the back surface 116 of the second adapter member is also configured to nest securely in the recessed surface and flutes of the gripping member.

The third adapter member 124 of the set of adapter members of the present invention is shown in FIGS. 10 and 11. As seen in FIG. 10, the third adapter 124 has a general semi-circular configuration that is slightly larger than one-half of a circle. The front surface of the adapter has a flat recessed center portion 126, a ledge 128 formed extending straight across a bottom portion of the peripheral edge of the adapter, and a band of V-shaped grooves 130 extending around the semi-circular peripheral edge of the adapter. The V-shape grooves 132 provided in the band 130 adapt the gripping member front surface 46 for holding tubular shaped objects of various different sizes. Each of the grooves 132 of the band 130 is arranged in the peripheral band with the bottom most edge 134 or valley of the groove being positioned along a line that extends radially outward from what would be the circular center 136 of the semi-circular adapter member.

The back surface 138 of the third adapter 124 is substantially identical to the back surfaces of the previously described adapters in that the back surface 138 is shaped complementary to the surface configurations of the front surface of the gripping member 42. The back surface 138 is also provided with a post 140 that projects from the back surface. The post is provided with a post hole 142 and a pin 144 that is inserted through the post hole to releasably attach the third adapter 124 to the front surface of the gripping member 42. The post 138 is inserted through the third hole 76 of the gripping member 42 and releasably secured in place by the pin 142 in much the same manner as described above with reference to the first adapter member.

The fourth adapter member 144 of the set of four adapter members is shown in FIGS. 12 and 13 of the drawing figures. As is best seen in FIG. 13, the fourth adapter member 144 has a projecting body 146 that distances the front surface 148 of the adapter member out forward from the front surface 46 of the gripping member 42 when the adapter member is attached to the gripping member. As seen in the drawing figures, the front surface 148 of the fourth adapter member has a circular configuration and the surface itself is formed as a shallow recess that tapers into the front of the adapter member body 146. The tapered recess 148 is provided with a plurality of projections 150 on the surface of the recess. The projections 150 are similar in shape to the projections 60 of the gripping member 42, as well as the projections of the previously described adapter members. As can be appreciated from drawing FIG. 13, the fourth adapter member 144 securely holds smaller objects inserted into the recessed surface 148 at the front of the adapter member in a position spaced outward from the gripping member 42, thereby providing easy access to the object held.

The fourth adapter member 144 also has a back surface 152 configured to complement the front surface of the gripping member 42 in much the same way as the previously described adapter members. The back surface 152 is also provided with a post 154 having a post hole 156 and pin 158 that is inserted into the post hole to releasably secure the adapter member 144 in position on the front face of the gripping member 42. The back surface configuration of the adapter member, along with the post and pin 154, 158, releasably secure the fourth adapter member 144 over the front surface of the gripping member 42 in the same manner as that described above with reference to the first embodiment of the invention.

The gripping assembly of the present invention is also provided with a flexible or resilient overlay 160. The overlay of the invention is shown in FIGS. 14 and 15 of the drawing figures. The overlay 160 also has a back surface 162 that is shaped to complement the front surface of the gripping member 42, enabling the overlay to nest in the surface configurations of the gripping member to securely but releasably attach the overlay to the gripping member. The front surface 164 of the overlay substantially resembles the front surface configurations of the gripping member 42 in that it is also configured with the three surface configurations of the gripping member. The flexible or resilient material of the overlay protects objects held by the gripping member 42 from being scratched or marred by the projections 60 or flute edges 64 of the gripping member.

While the present invention has been described by reference to specific embodiments, it should be understood that modifications and variations of the invention may be constructed without departing from the scope of the invention defined in the following claims.

What is claimed is:

1. A gripping assembly for use with a gripping tool of the type having a pair of mutually opposed jaw faces that are selectively moved toward each other to engage and hold an object therebetween, the gripping assembly comprising:

a gripping member;

the gripping member having an attachment means for attaching the gripping member to a jaw face of a gripping tool, the attachment means securing the gripping member against movement relative to the jaw face of the gripping tool;

the gripping member having a front planar surface and a gripping surface for engaging against an object and preventing movement of the object relative to the gripping member; the gripping surface having a first means for receiving an object in the first means and for securely holding the object received therein against movement relative to the gripping member; the gripping member having a second means on the first means for engaging an object received in the first means and securely holding the object engaged against movement relative to the gripping member; and the gripping member having a third means formed into the first means for receiving an object in the third means and securely holding the object received therein against movement relative to the gripping member;

a plurality of adapter members, each adapter member having a front and a back surface;

a connector means on the adapter member back surface for releasably attaching the adapter member to the gripping member; and, a second gripping surface on the adapter member front surface for engaging against an object and holding the object against movement of the object relative to the adapter member and the gripping member.

2. The gripping assembly of claim 1, wherein:

the gripping member has a hole formed therein, and the connector means of each adapter member includes a post insertable through the hole formed in the gripping member to releasably attach each adapter member to the gripping member.

3. The gripping assembly of claim 1, further comprising:

a plurality of overlays, each overlay having a front and a back surface, the back surface of each overlay having a configuration complementary to one of the gripping member and adapters front surface for nesting the overlay on the gripping member or adapter front surface, and each overlay front surface being resilient for engaging an object and securely holding the object against movement relative to the overlay and gripping member or adapter.

4. A gripping assembly for use with a gripping tool of the type having a pair of mutually opposed jaw faces that are selectively moved toward each other to engage and hold an object therebetween, the gripping assembly comprising:

a gripping member;

the gripping member having an attachment means for attaching the gripping member to a jaw face of a gripping tool, the attachment means securing the gripping member against movement relative to the jaw face of the gripping tool;

the gripping member having a front planar surface and a gripping surface for engaging against an object and preventing movement of the object relative to the gripping member; the gripping surface having a first means for receiving an object in the first means and for securely holding the object received therein against movement relative to the gripping member; the gripping member having a second means on the first means for engaging an object received in the first means and securely holding the object engaged against movement relative to the gripping member; and the gripping member having a third means formed into the first means for receiving an object in the third means and securely holding the object received therein against movement relative to the gripping member;

the first means includes a hollow, the hollow having a recessed surface extending into the gripping member from the front surface of the gripping member;

the second means includes a plurally of projections formed over the recessed surface of the hollow;

the third means includes a plurality of flutes formed into the recessed surface of the hollow, each flute has a peripheral edge on the recessed surface of the hollow, and each flute has an interior surface that extends in a concave configuration into the gripping member from the recessed surface, and the peripheral edge of each flute has a general teardrop shape.

5. The gripping assembly of claim 4, wherein:

the recessed surface of the hollow has a tapered configuration that extends into the gripping member to a center area of the hollow.

6. The gripping assembly of claim 4, wherein:

each flute has a peripheral edge on the planar surface of the gripping member, and the interior surface of each flute extends in a concave configuration into the gripping member from the planar surface.

7. The gripping assembly of claim 4, wherein:

the gripping member has a hole formed therein for engaging a pointed object by inserting a point of the object into the hole.

8. A gripping assembly for use with a gripping tool of the type having a pair of mutually opposed jaw faces that are selectively moved toward each other to engage and hold an object therebetween, the gripping assembly comprising:

a gripping member;

the gripping member having an attachment means for attaching the gripping member to a jaw face of a gripping tool, the attachment means securing the gripping member against movement relative to the jaw face of the gripping tool;

the gripping member having a front planar surface and a gripping surface for engaging against an object and preventing movement of the object relative to the gripping member; the gripping surface having a first means for receiving an object in the first means and for securely holding the object received therein against movement relative to the gripping member; the gripping member having a second means on the first means for engaging an object received in the first means and securely holding the object engaged against movement relative to the gripping member; and the gripping member having a third means formed into the first means for receiving an object in the third means and securely holding the object received therein against movement relative to the gripping member; and, an overlay having a front surface and a back surface, the back surface having a configuration complementary to the gripping member front surface for nesting the overlay on the gripping member front surface, and the overlay front surface being resilient for engaging an object and securely holding the object against movement relative to the overlay and gripping member.

9. A gripping assembly for use with a gripping tool of the type having a pair of mutually opposed jaw faces that are selectively moved toward each other to engage and hold an object therebetween, the gripping assembly comprising:

a gripping member having a front and back surface;

an attachment means on the gripping member back surface for releasably attaching the gripping member to a jaw face of a gripping tool and securing the gripping member against movement relative to the jaw face of the gripping tool;

a hollow having a recessed surface extending into the gripping member front surface for receiving an object inside the hollow and securely holding the object received therein against movement relative to the gripping member;

the recessed surface of the hollow having a plurality of projections formed thereon for engaging an object received in the hollow and securely holding the object engaged against movement relative to the gripping member;

a plurality of flutes formed into the recessed surface for receiving an object therein and securely holding the object received against movement relative to the gripping member;

a plurality of adapter members, each adapter member having a front and back surface;

a connector means on the adapter member back surface for releasably attaching the adapter member to the gripping member; and, a gripping surface on the adapter member front surface for engaging against an object and holding the object against movement relative to the adapter member and the gripping member.

10. The gripping assembly of claim 9, further comprising:

a plurality of overlays, each overlay having a front surface and a back surface, the back surface having a configuration complementary to one of the gripping member front surface and the adapters front surfaces for releasably securing the overlay over the gripping member or adapter front surface, and the overlay front surface being resilient for engaging an object and securely holding the object against movement relative to the overlay and gripping member or adapter.

11. A gripping assembly for use with a gripping tool of the type having a pair of mutually opposed jaw faces that are selectively moved toward each other to engage and hold an object therebetween, the gripping assembly comprising:

a gripping member having a front and back surface;

an attachment means on the gripping member back surface for releasably attaching the gripping member to a jaw face of a gripping tool and securing the gripping member against movement relative to the jaw face of the gripping tool;

a hollow having a recessed surface extending into the gripping member front surface for receiving an object inside the hollow and securely holding the object received therein against movement relative to the gripping member;

the recessed surface of the hollow having a plurality of projections formed thereon for engaging an object received in the hollow and securely holding the object engaged against movement relative to the gripping member;

a plurality of flutes formed into the recessed surface for receiving an object therein and securely holding the object received against movement relative to the gripping member, each flute of the plurality of flutes has a peripheral edge on the recessed surface of the hollow, and each flute has an interior surface that extends in a concave configuration into the gripping member from the recessed surface; and, the peripheral edge of each flute has a general teardrop shape.

12. The gripping assembly of claim 11, wherein:

the recessed surface of the hollow has a tapered configuration that extends into the gripping member to a center area of the hollow.

13. A gripping assembly for use with a gripping tool of the type having a pair of mutually opposed jaw faces that are selectively moved toward each other to engage and hold an object therebetween, the gripping assembly comprising:

a gripping member having a front and back surface;

an attachment means on the gripping member back surface for releasably attaching the gripping member to a jaw face of a gripping tool and securing the gripping member against movement relative to the jaw face of the gripping tool;

a hollow having a recessed surface extending into the gripping member front surface for receiving an object inside the hollow and securely holding the object received therein against movement relative to the gripping member;

the recessed surface of the hollow having a plurality of projections formed thereon for engaging an object received in the hollow and securely holding the object engaged against movement relative to the gripping member;

a plurality of flutes formed into the recessed surface for receiving an object therein and securely holding the object received against movement relative to the gripping member;

a plurality of adapter members, each adapter member having a front and back surface;

a connector means on each adapter member back surface for releasably attaching each adapter member to the gripping member; and, a gripping surface on each adapter member front surface for engaging against an object and holding the object against movement of the object relative to each adapter member and the gripping member.

14. A gripping assembly for use with a gripping tool of the type having a pair of mutually opposed jaw faces that are selectively moved toward each other to engage and hold an object therebetween, the gripping assembly comprising:

a gripping member having a front and back surface;

an attachment means on the gripping member back surface for releasably attaching the gripping member to a jaw face of a gripping tool and securing the gripping member against movement relative to the jaw face of the gripping tool;

at least one flute formed extending into the gripping member front surface for receiving an object inside the flute and securely holding the object received therein against movement relative to the gripping member, the flute having a peripheral edge on the gripping member front surface and an interior surface that extends in a concave configuration into the gripping member from the front surface, and the peripheral edge of the flute having a general teardrop shape.

15. The gripping assembly of claim 14, wherein:

a plurality of flutes are formed extending into the gripping member front surface, each flute of the plurality of flutes has a peripheral edge on the gripping member front surface and an interior surface that extends in a concave configuration into the gripping member from the front surface, and the peripheral edge of each flute of the plurality of flutes has a general teardrop shape.

* * * * *